United States Patent [19]

Palmer

[11] 4,391,535

[45] Jul. 5, 1983

[54] METHOD AND APPARATUS FOR CONTROLLING THE AREA OF A THERMAL PRINT MEDIUM THAT IS EXPOSED BY A THERMAL PRINTER

[75] Inventor: Roger C. Palmer, Edmonds, Wash.

[73] Assignee: Intermec Corporation, Lynnwood, Wash.

[21] Appl. No.: 291,625

[22] Filed: Aug. 10, 1981

[51] Int. Cl.[3] ..... B41J 3/20

[52] U.S. Cl. ..... 400/120; 346/76 PH; 219/216

[58] Field of Search ..... 400/120; 346/76 PH; 219/216 PH; 250/316

[56] References Cited

U.S. PATENT DOCUMENTS

| | | | |
|---|---|---|---|
| 3,453,648 | 7/1969 | Stegena | 346/76 |
| 3,577,137 | 5/1971 | Brennan, Jr. | 400/120 |
| 3,609,294 | 9/1971 | Cady, Jr. et al. | 219/216 |
| 3,725,898 | 4/1973 | Canton | 346/76 PH |
| 3,726,212 | 4/1973 | Combs | 101/21 |
| 3,736,406 | 5/1973 | Vossen et al. | 219/216 |
| 3,771,634 | 11/1973 | Lamb | 197/1 R |
| 3,777,116 | 12/1973 | Brescia et al. | 219/216 |
| 3,947,854 | 3/1976 | Hansen et al. | 346/76 |
| 3,975,707 | 8/1976 | Ito et al. | 346/76 PH |
| 4,070,680 | 1/1978 | Shelley | 346/76 R |
| 4,074,109 | 2/1978 | Baraff et al. | 219/216 |
| 4,113,391 | 9/1978 | Minowa | 346/76 PH |
| 4,169,682 | 10/1979 | Norman | 400/120 |
| 4,170,422 | 10/1979 | Bilek | 400/120 |
| 4,224,628 | 9/1980 | Murray | 346/76 PH |
| 4,232,325 | 10/1980 | Bradshaw et al. | 346/76 R |
| 4,284,876 | 8/1981 | Ishibashi et al. | 346/76 PH |

FOREIGN PATENT DOCUMENTS

| | | | |
|---|---|---|---|
| 56-38278 | 4/1981 | Japan | 400/120 |
| 56-77173 | 6/1981 | Japan | 400/120 |

*Primary Examiner*—William Pieprz

*Attorney, Agent, or Firm*—Christensen, O'Connor, Johnson & Kindness

[57] ABSTRACT

After discussion of a typical prior art thermal printer that is capable of providing precise printing of machine-readable characters on a thermal print medium through the use of an electrically-resistive thermal print element, a thermal model of the thermal print element and the heat transfer relationships between the thermal print element and its surrounding environment is constructed. From this thermal model, an equivalent electrical model is constructed which provides a signal representing the estimated temperature of the thermal print element. This signal is then used to control the exposure time of the thermal print (the time that is sufficient to raise the temperature of only an incremental area of the thermal print medium in uniform contact with the thermal print element to or above the threshold temperature) and to control the rest time of the thermal printer (the time following the exposure time that is sufficient to allow the temperature of the thermal print element to decrease to a value that will not result in additional exposure of the thermal print medium upon movement thereof).

10 Claims, 6 Drawing Figures

METHOD AND APPARATUS FOR CONTROLLING THE AREA OF A THERMAL PRINT MEDIUM THAT IS EXPOSED BY A THERMAL PRINTER

FIELD OF THE INVENTION

This invention generally relates to the field of thermal printing apparatus and methods, and, more particularly, to a method and apparatus for controlling the area of a thermal print medium that is exposed by a thermal printer.

BACKGROUND OF THE INVENTION

In application Ser. No. 231,151, filed Feb. 3, 1981, Allais et al., THERMAL PRINTING APPARATUS AND METHOD, which is assigned to the assignee of the present invention and which has been abandoned, a thermal printer is disclosed which is capable of providing precise printing of machine-readable characters, such as bar code characters, on a thermal print medium. Each machine-readable character typically consists of a predetermined number of sequential binary bits which, in a bar code, are represented by a sequential series of alternating bars and spaces. In one type of bar code, each bit is represented by a single bar or space, with the width of each bar and space denoting the binary value of its corresponding bit. In order to avoid code reading errors, it is very important that the width of each bar and the width of each space (sometimes referred to as the "pitch" or separation between adjacent bars) be maintained within very narrow tolerances.

A thermal printer such as that disclosed in application Ser. No. 231,151 comprises a print head assembly including a thermal print head and an opposing pressure member. The thermal print head includes at least one electrically-resistive thermal print element that is formed on a substrate, with the thermal print element being capable of producing heat upon the application of an electrical signal thereto. A thermal print medium, such as a specially-coated paper in sheet or strip form, is interposed between the thermal print head and the pressure member, whereby the pressure member maintains the thermal print medium in contact with the thermal print element. The characteristics of the thermal print medium are such that when the thermal print medium is at ambient temperature, the coating thereof is inactive. However, when the temperature of the thermal print medium is raised to or above a certain threshold temperature (which varies depending upon the type of coating and paper utilized), the coating undergoes a chemical reaction and is exposed. Such exposure results in a change in the light-reflective characteristics of the coating. In the great majority of thermal print mediums currently available, the coating is darkened upon exposure. Accordingly, when an electrical signal is applied to the thermal print element, the heat produced thereby raises the temperature of the thermal print medium above a threshold temperature so as to expose at least a portion of the coating whereby a character or a portion of a character is printed.

If a thermal printer is to be used to print machine-readable characters such as bar code characters, it is critical that the thermal printer be capable of precisely controlling the area of the thermal print medium that is exposed. The thermal printer in application Ser. No. 231,151 meets this objective in the following manner. The print head assembly includes a print head support which rigidly mounts the thermal print head in a fixed position. The print head support is composed of a material having a high thermal conductivity, and has a thermal mass that is substantially greater than the thermal mass of the thermal print head. Heating means are provided for maintaining the temperature of the print head support at a reference temperature below the threshold temperature of the thermal print medium, and a pressure member is provided that is supported in opposing relationship with the thermal print head and that is resiliently urged into contact with the thermal print element. Means are also provided for selectively transporting the thermal print medium to and from the print head assembly, the thermal print medium when so transported passing between the thermal print head and the pressure member.

The thermal print element has an area which is substantially equal to the desired incremental area of each character to be printed. In order to print such an incremental area, the thermal print medium is moved relative to the thermal print head to the position at which the incremental area is to be printed and then stopped. The mechanical arrangement described insures that the thermal print element will be substantially at the reference temperature, and that the incremental area of the thermal print medium will be urged into uniform contact with the thermal print element by the pressure member so that the incremental area of the thermal print medium will be quickly brought to the reference temperature. Thereafter, an electrical signal having a substantially constant amplitude is applied to the thermal print element for a predetermined "exposure" time that is sufficient to raise the temperature of only the incremental area of the thermal print medium in uniform contact with the thermal print element from the reference temperature to or above the threshold temperature. Upon the elapse of the exposure time, the electrical signal is immediately terminated so that only the desired incremental area of the thermal print medium is exposed. Upon the elapse of an additional time (the "rest" time) that is sufficient to allow the temperature of a thermal print element to decrease to a value that will not result in additional exposure or "smearing" of the thermal print medium upon movement thereof, the thermal print medium is moved to the position of the next incremental area to be printed and the process just described in repeated.

Although the thermal printer in application Ser. No. 231,151 is believed to be the first thermal printer including a thermal print head that is capable of printing with the very narrow tolerances required for machine-readable characters, it is subject to certain disadvantages. First, as a coded record including a plurality of successive characters is printed, the actual temperature of the thermal print element increases slightly from the reference temperature. In order to maintain the same tolerances throughout the coded record, it is necessary that the exposure and rest times be successively decreased in an empirically-determined manner from the beginning to the end of the coded record. Second, there is no provision for measuring or estimating the actual temperature of the thermal print element (or the portion of the thermal print medium in contact therewith) at any point in time, thereby necessitating empirical determinations of the exposure and rest times for each thermal print medium used. In addition, the threshold temperature will vary from sample to sample of a given thermal print medium so that it is often necessary in practice to adjust the exposure and rest times. Third, the heating means used to maintain the temperature of the print head support at the reference temperature requires a certain amount of time to bring the print head support to the reference temperature upon start-up of the thermal printer and consumes a significant amount of electrical power, thereby leading to delays in operation of the thermal printer and making the thermal printer relatively expensive to operate.

It is therefore an object of this invention to provide an improved method and apparatus for controlling the area of a thermal print medium that is exposed by a thermal printer.

It is a further object of this invention to provide such an improved method and apparatus which functions to accurately estimate the actual temperature of the thermal print element at any point in time and which accordingly eliminates the need for empirical determinations of exposure and rest times.

It is still a further object of this invention to provide such a method and apparatus which permits exposure times and rest times to be easily and quickly adjusted for variations in threshold temperature of the thermal print medium.

It is another object of this invention to provide such a method and apparatus which eliminates the need for separate heting of the print head support and which accordingly reduces start-up delays in operating the thermal printer and the cost of constructing and operating the thermal printer.

SUMMARY OF THE INVENTION

The foregoing objects, as well as additional objects and advantages that will be apparent to those of ordinary skill in the art after consideration of the entire specification, are achieved in an apparatus for controlling the area of a thermal print medium that is exposed by a thermal printer. The thermal print medium is such that any portion thereof is exposed when its temperature equals or exceeds a predetermined threshold temperature. The thermal printer includes: an electrically-resistive thermal print element having a surface that is in good thermal contact with the thermal print medium and that has an area equal to the desired exposure area of the thermal print medium; and, driver means for applying an electrical signal having a substantially constant amplitude to the thermal print element.

The apparatus comprises:

an electrical energy storage means representing the thermal mass of the thermal print element and being adapted to provide a first signal whose amplitude is proportional to the instantaneous amount of electrical energy stored therein;

first means for transferring electrical energy into the electrical energy storage means at a rate proportional to the power being supplied to the thermal print element by the substantially-constant amplitude electrical signal applied thereto; and, second means transferring electrical energy to and from the electrical energy storage means in relation to the heat transferred between the thermal print element and the environment in heat transfer relationship with the thermal print element.

The electrical energy storage means, the first means, and the second means comprise an electrical model that is the equivalent of a thermal model of the thermal print element and the heat transfer relationships between the thermal print element and its surrounding environment, so that the amplitude of the first signal is proportional to the instantaneous temperature of the thermal print element.

In order to control the time that the thermal print medium is exposed, the apparatus also comprises:

a third means providing a second signal whose amplitude is related to a temperature at least equal to the threshold temperature of the thermal print medium; and, a fourth means concurrently enabling the driver means of the thermal printer and the first means, and concurrently disabling the driver means of the thermal printer and the first means whenever the amplitude of the first signal exceeds that of the second signal.

In the case where the thermal printer is operative to maintain the thermal print medium stationary during exposure, it is possible that the thermal print medium may be further exposed or smeared if moved too quickly following exposure. Accordingly, the apparatus may also comprise:

fifth means providing a third signal whose amplitude is related to a temperature that is sufficiently below the threshold temperature so as to not result in exposure of the thermal print medium upon movement thereof; and, sixth means enabling the thermal printer to move the thermal print medium whenever the amplitude of the first signal is less than the amplitude of the third signal.

BRIEF DESCRIPTION OF THE DRAWINGS

The invention can best be understood by reference to the following portion of the specification, taken in conjunction with the accompanying drawings, in which.

DESCRIPTION OF A PREFERRED EMBODIMENT

Figures 1, 2:
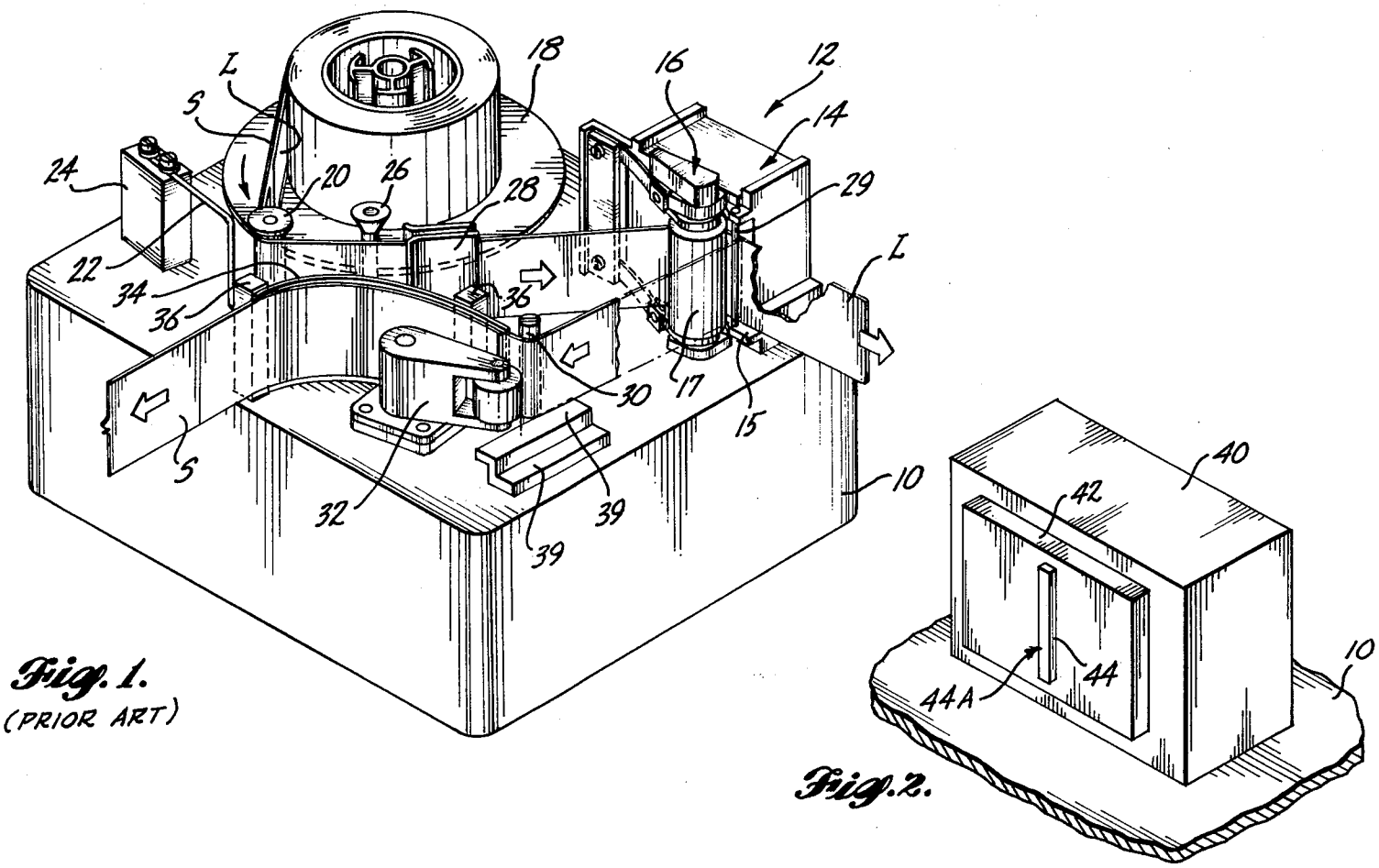
Fig. 1. (PRIOR ART)
FIG. 1 is a pictorial view of a thermal printer known to the prior art.
FIG. 2 is a schematic view of a thermal print head and print head support used in the thermal printer of FIG. 1.

Referring now to FIG. 1, a thermal printer similar to that disclosed in application Ser. No. 231,151 includes a deck 10 which supports a print head assembly 12 including a print head support 14 and an opposing pressure member 16. As will be explained in more detail hereinafter, a thermal print head is mounted on print head support 14. The thermal print head includes at least one thermal print element, and a roller 17 forming part of pressure member 16 is resiliently urged into contact with the thermal print element. Print stock consisting of or including a thermal print medium is obtained from a print stock supply reel 18 which is rotatably supported on deck 10. In the preferred embodiment, the thermal print medium consists of a plurality of labels L removably adhering to and spaced along an elongated strip of label stock backing S. From print stock supply reel 18, the print stock passes around a tension roller 20 which is supported by a spring arm 22 secured to a support 20 mounted on deck 10, and then passes around a roller 26, through a stock sensor 28, and to the print head assembly 12. At print head assembly 12, the print stock is interposed between pressure member 16 and print head support 14 so that roller 17 contacts the side of label stock backings opposite that bearing labels L to press each of the labels L into contact with the thermal print element. Immediately after leaving the vicinity of the thermal print element, the print stock is passed around a label stripping pin 29 mounted on print head support 14 and, in doing so, changes its direction by approximately 90° whereby each of the labels L is successively removed from label stock backing S in a well-known manner. From label stripping pin 29, label stock backing S is passed between a drive capstan 30 and an associated pinch roller 32 pivotally mounted on deck 10, and is thereafter guided by a curved plate 34 (which is supported from deck 10 by a pair of spaced-apart supports 36) to a point where it exits from deck 10 and may thereafter be discarded. As the print stock is transported to and from print head assembly 12, the vertical position of the print stock, and therefore the vertical alignment of each label with the thermal print element, is established by a horizontal reference surface 15 defined on print head support 14 and by a horizontal reference surface 39 of a guide 38 secured to deck 10 in proximity to drive capstan 30, with the lower edge surface of label stock backing S riding on both horizontal reference surfaces.

An electronic control means (discussed hereinafter with reference to FIG. 6) is provided which is responsive in part to a control signal from stock sensor 28 and which functions to cause drive capstan 30 to be rotated by a drive capstan motor supported within deck 10 (and not illustrated) so as to move the print stock with respect to the print head assembly until a portion of a label onto which a character (or portion thereof) is to be printed is appropriately positioned with respect to the thermal print element. When the label is so positioned, the electronic control means terminates rotation of drive capstan 30, and then applies an electrical signal to the thermal print element for a time (the exposure time) sufficient to raise the temperature of only that portion of the label that is in contact with the thermal print element above the threshold temperature. After an additional time (the rest time) that is sufficient to avoid smearing of the label upon movement thereof, the electronic control means again causes drive capstan 30 to rotate until a successive portion of the label onto which a successive character (or portion thereof) is to be printed is appropriately positioned with respect to the thermal print element, and the cycle just described is repeated. As the successive characters are thus printed, the label is stripped from the label stock backing by label stripping pin 29. After the entire label has been printed with the coded record, the label is removed by hand from the label stock backing and applied to any desired object.

With reference now to FIG. 2, print head support 14 may be schematically represented as a block 40 of thermally-conductive material that is secured to deck 10, and the thermal print head includes a substrate 42 of ceramic material that is secured to and in good thermal contact with block 40 and that has conventionally formed thereon a thermal print element 44 of electrically-resistive material. A portion of a label is maintained in uniform and good thermal contact with a substantially planar surface 44A of thermal print element 44 (by roller 17 of pressure member 16 as previously described), and surface 44A has a height that is equal to the desired height of each bar to be printed and a width that is equal to an incremental bar width used to print each bar. Preferably, this incremental bar width is equal to the width of the narrowest bar to be printed.

Figure 3:
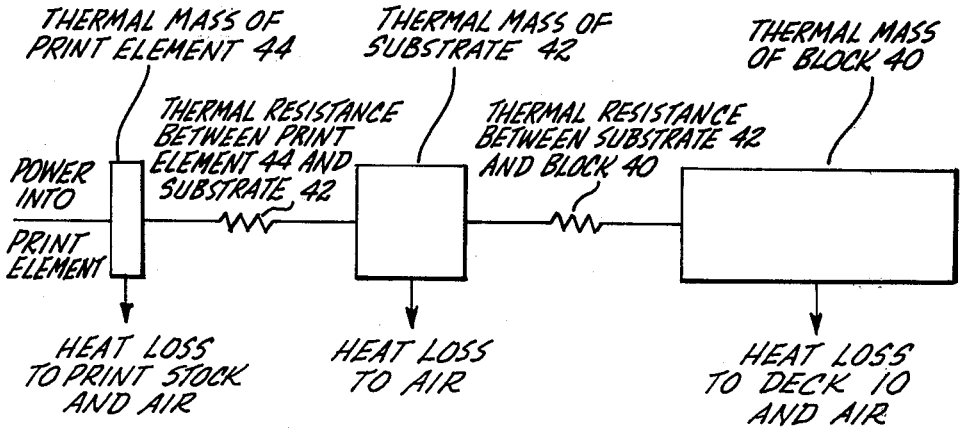
FIG. 3 is a thermal model of the structure in FIG. 2.

FIG. 3 illustrates a thermal model of the structure in FIG. 2, which thermal model includes schematic representations of the respective thermal masses of print element 44, substrate 42 and block 40. Under the assumption that print element 44, substrate 42 and block 40 are each at or above air temperature, it can be seen that the power into print element 44 (which results from the application of an electrical signal thereto) produces heat that is conducted through the thermal mass of print element 44. The heat thus conducted is lost to the print stock (including the label) and the air and is also conducted through the thermal resistance between print element 44 and substrate 42 to the thermal mass of substrate 42. The heat conducted through the thermal mass of substrate 42 is lost to the air and is also conducted through the thermal resistance between substrate 42 and block 40 to the thermal mass of block 40. The heat conducted through the thermal mass of block 40 is then lost to deck 10 and to the air.

Figure 4:
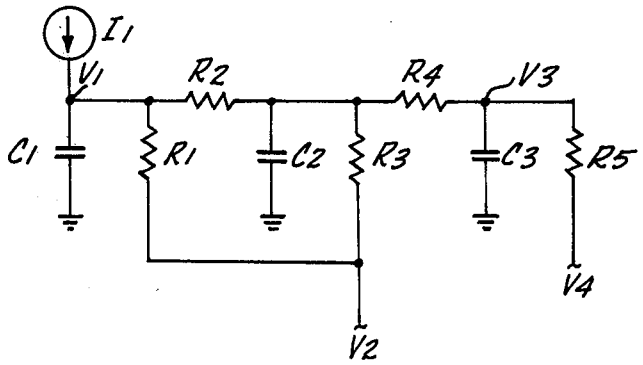
FIG. 4 is an electrical model corresponding to the thermal model of FIG. 3.

Given this thermal model, an equivalent electrical model can be constructed as illustrated in FIG. 4. An output current I1 from a current source is coupled to a first side of a capacitance C1 whose second side is connected to ground or reference potential. First sides of resistances R1 and R2 are connected to the first side of capacitance C1. A second side of resistance R2 is connected to the first side of each of capacitance C2, a resistance R3, and a resistance R4, and a second side of resistance R1 is connected to the second side of resistance R3. A second side of resistance R4 is connected to the first side of each of a capacitance C3 and a resistance R5, and the second side of capacitance C3 is connected to ground or reference potential. A voltage V1 appears at the common junction of capacitance C1, resistance R1 and resistance R2, a voltage V2 is supplied to the common junction of resistances R1 and R3, a voltage V3 appears at the common junction of resistance R4, capacitance C3 and resistance R5, and a voltage V4 is supplied to a second side of resistance R5.

From a comparison of FIGS. 3 and 4, it will be recognized that the components in FIG. 4 are the electrical equivalents of the elements in FIG. 3, as follows:

C1=thermal mass of print element 44
R1=heat transfer characteristic between print element 44, and print stock and air
R2=heat transfer characteristic between print element 44 and substrate 42
C2=thermal mass of substrate 42
R3=heat transfer characteristic between substrate 42 and air
R4=heat transfer characteristic between substrate 42 and block 40
C3=thermal mass of block 40
R5=heat transfer characteristic between block 40, and deck 10 and air It will also be recognized that the following signals are either present in or supplied to the electrical model in FIG. 4:

I1=power into print element 44
V1=estimated temperature of print element 44
V2=measured air temperature
V3=estimated temperature of block 40
V4=measured temperature of deck 10 and air Provided that the component values are appropriately chosen as described hereinafter, that current I1 is chosen and controlled to accurately represent the power into the print element, and that the voltages supplied to the electrical model (voltages V2 and V4) are appropriately scaled, it can be seen the voltage V1 in the electrical mode in FIG. 4 will be an accurate estimation of the instantaneous temperature of print element 44, which estimation can be used to precisely control the exposure time and rest time of the thermal printer.

Figure 5:
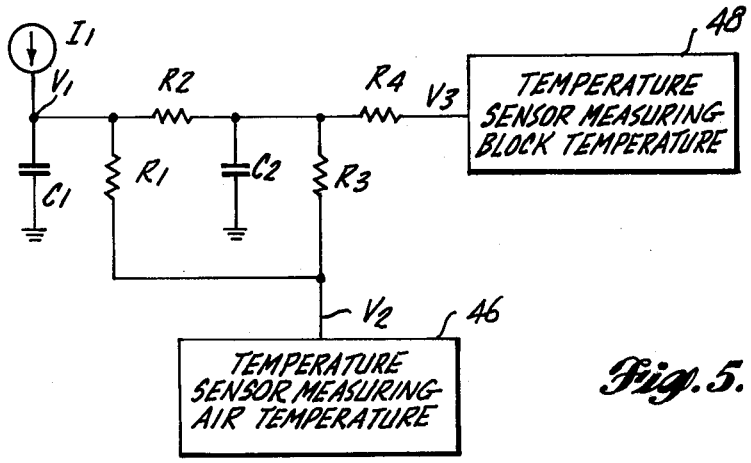
FIG. 5 is a simplification of the electrical model of FIG. 4.

Since it is relatively easy to directly measure both the temperature of the air and the temperature of block 40, the electrical model in FIG. 4 may be simplified as illustrated in FIG. 5. A temperature sensor 46 (such as a thermistor circuit) is provided for measuring air temperature and provides voltage V2. Likewise, a temperature sensor 48 (which may also comprise a thermistor circuit) is provided for measuring the temperature of block 40 and provides voltage V3, thereby eliminating capacitance C3 and resistance R5 in FIG. 4 and the need to measure the temperature represented by voltage V4. Preferably, the thermistor in temperature sensor 46 is mounted on deck 10 in a location that is exposed to the ambient and that is not subject to substantial heat transfer from any heat sources in the thermal printer, and the thermistor in temperature sensor 48 is mounted directly on block 40 in a convenient location.

Figure 6:
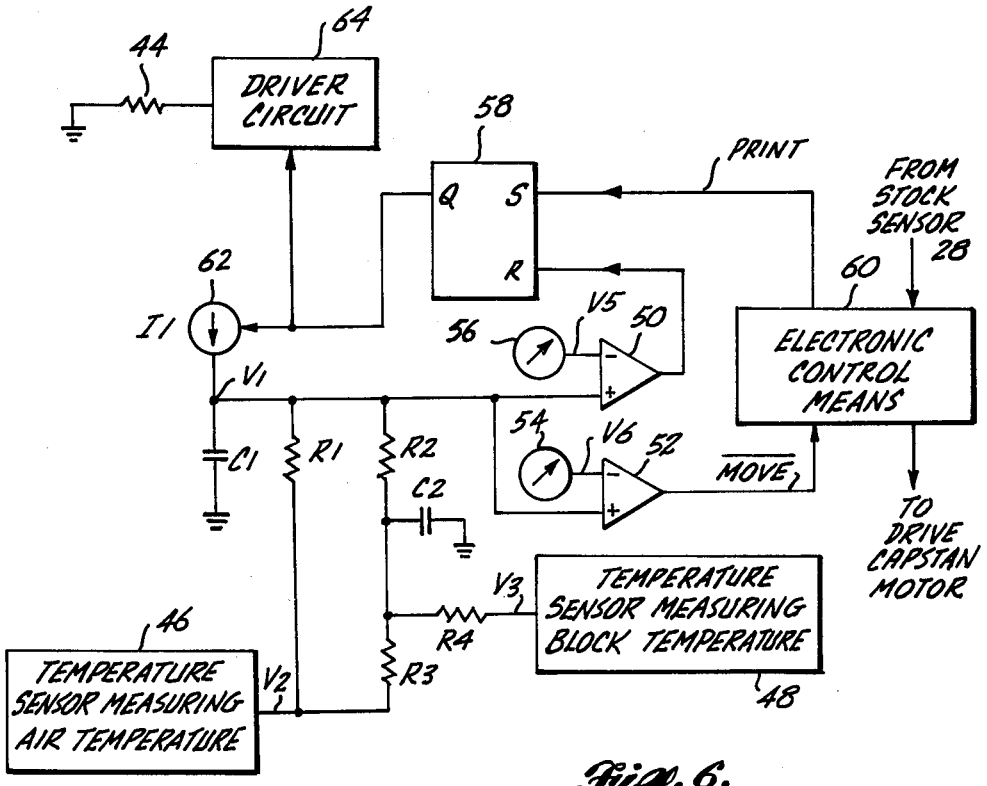
FIG. 6 is an electrical block diagram of a practical circuit that includes the electrical model of FIG. 5 and that is adapted to control the exposure time and rest time of the thermal printer.

The simplified electrical mode in FIG. 5 may then be incorporated into a practical circuit which functions to control exposure time and rest time in accordance with estimated print element temperature, or, voltage V1, as seen in FIG. 6. Voltage V1 is supplied to the noninverting inputs of comparators 50 and 52. A voltage V5 that is related to the threshold temperature of the thermal print medium and that is obtained from an adjustable voltage source 54 is applied to the inverting input of comparator 50, and a voltage V6 that represents an empirically-determined temperature below the threshold temperature and that is obtained from an adjustable voltage source 56 is applied to the inverting input of comparator 52. The output signal from comparator 50 is applied to a reset (R) input of flip-flop 58 and a PRINT signal from an electronic control means 60 of the thermal printer is applied to a set (S) input of flip-flop 58. The output signal from comparator 52, or the MOVE signal, is applied to electronic control means 60, which also receives a control signal from stock sensor 28 and provides a control signal to the drive capstan motor for drive capstan 30 as previously described. The signal appearing on a Q output of flip-flop 58 is coupled to a control input of a gatable constant-current source 62 and to the input of a drive circuit 64 whose output is coupled through electrically-resistive print element 44 to ground potential. Whenever the signal on the Q output of flip-flop 58 has a high logic level, driver circuit 64 is enabled so as to supply a constant-amplitude electrical signal to print element 44, and gatable constant-current source 62 is enabled so as to supply a constant current (representing the power supplied to print element 44) to capacitance C1.

In operation, electronic control means 60 is responsive in part to the control signal from stock sensor 28 to supply a control signal to the drive capstan motor until a desired incremental area of the label which is to be exposed is positioned in contact with print element 44. When the label is so positioned, electronic control means 60 terminates the control signal to the drive capstan motor so that the label remains stationary, and then causes the PRINT signal to go to a high logic level whereby flip-flop 58 is set. When flip-flop 58 is set, the output signal on the Q output thereof has a high logic level so that driver circuit 64 and gatable constant-current source 62 are enabled. Due to the application of power to print element 44, the actual temperature thereof begins to rise. As the actual temperature rises, the estimated temperature or voltage V1 increases in a manner determined by the values of the components in the electrical model (i.e., the values of capacitances C1 and C2 and resistances R1, R2, R3 and R4), the value of current I1, and the values of voltages V2 and V3. As the temperature of the print element continues to rise, a point will be reached where the value of voltage V1 exceeds the value of voltage V5, whereupon the output signal from comparator 50 goes to a high logic level to reset flip-flop 58 and therefore disable both driver circuit 64 and gatable constant-current source 62. The value of voltage V5 is selected so as to represent a temperature at least equal to and preferably substantially above the threshold temperature of the thermal print medium. Accordingly, the application of power to print element 44 (and therefore any further increase in the temperature thereof) is terminated when the estimated temperature exceeds the threshold temperature, and adjustable voltage source 54 therefore provides selective adjustment of exposure time. When flip-flop 58 is reset and terminates application of power to print element 44, the actual temperature of the print element decreases. As the actual temperature decreases, the estimated temperature or voltage V1 also decreases in a manner determined by the component values of the electrical model and the values of voltages V2 and V3. At some point in time, voltage V1 will be less than voltage V6, whereby comparator 52 provides the MOVE signal to electronic control means 60 which thereafter moves the print stock to the location of the next incremental area to be printed on the label, and the cycle just described is repeated. The value of voltage V6 represents an empirically-determined temperature of the print element that is above the expected maximum air temperature and that is sufficiently below the threshold temperature of the thermal print medium so as to not result in smearing of the label upon subsequent movement thereof, and adjustable voltage source 56 therefore provides selective adjustment of rest time.

It has been found in practice that the effect of air temperature on print element temperature is negligible so that resistances R1 and R3 and temperature sensor 46 may be eliminated. In such a situation, the component, current and voltage values in FIG. 6 may be determined as follows.

First, a temperature-to-voltage scaling factor is chosen that insures that the value of voltage V1 will not approach the value of the power supply voltage used for the circuit. As an example, let it be assumed that the peak instantaneous temperature of the print element is 200° C. and that the power supply voltage is +15 VDC. In this example, a scaling factor of 20° C./volt would be appropriate (so that voltage V1=10 VDC when the print element is at its peak instantaneous temperature).

Second, a time constant related to the time for the print element to raise the thermal print medium to a temperature equaling or exceeding the theshold temperature is then empirically determined by applying successively longer pulses (with a relatively long interval between successive pulses to allow print element-cool down) and by visually observing the exposure of the thermal print medium that results until a proper exposure is obtained. Having thus determined the "printing" time constant, the values of current I1 and capacitance C1 are chosen so that voltage V1 will reach a value that is related to the print element temperature required for proper exposure during the interval represented by the "printing" time constant.

Third, under the assumption that the thermal mass of the substrate is much greater than the thermal mass of the print element, the value of capacitance C2 is set at least ten times greater than the value of capacitance C1.

Fourth, a value for resistance R2 is selected so that the time constant of resistance R2 and capacitance C1 is equal to a "cool-down" time constant of the print element that is related to the time that is required for the temperature of the print element to decrease from its peak instantaneous temperature to a temperature that will not result in smearing of the label.

Fifth, under the further assumption that the thermal resistance between the substrate and the block approximates the thermal resistance between the print element and the substrate, the value of resistance R4 is set equal to that of resistance R2 and the values of resistances R2 and R4 and capacitance C2 are adjusted so that the time constant R2/2(C2) approximates a "temperature build-up" time constant that is related to the time for the temperature of the print element to increase from its normal temperature when the print element is de-energized to the smearing temperature and that is observed during printing of successive characters.

Sixth, the value of capacitance C2 is then further adjusted (while insuring that the value is at least ten times the value of capacitance C1) while printing successive test labels that contain coded records having differing amounts and numbers of bars to achieve acceptable exposure quality.

Seventh, temperature sensor 48 is designed so that its temperature-to-voltage scaling factor equals that previously described. This scaling factor is further adjusted as a result of printing tests that are conducted at the expected upper and lower limits of block temperature.

Eighth, voltage sources 54 and 56 are designed so that voltages V5 and V6 therefrom are adjustable in a range from ground potential to that value of voltage V1 that represents the peak instantaneous temperature of the print element.

While the invention has been described with reference to a preferred embodiment, it is to be clearly understood by those skilled in the art that the invention is not limited thereto. For example, the thermal masses can be represented by inductances, the temperatures can be represented by currents, and the power applied to the thermal print element can be represented by a voltage. As another example, the thermal model (or an equivalent electrical model) may be represented in software (wherein the various thermal masses are registers, the various temperatures are input and process variables, and the various heat transfer characteristics are proportionality constants). Therefore, the scope of the invention is to interpreted only in conjunction with the appended claims.

The embodiments of the invention wherein an exclusive property or privilege is claimed are defined as follows:

1. An apparatus for controlling the area of a thermal print medium that is exposed by a thermal printer, the thermal print medium being such that any portion thereof is exposed when its temperature equals or exceeds a predetermined threshold temperature, the thermal printer including an electrically-resistive thermal print element having a surface that is in good thermal contact with the thermal print medium and that has an area equal to the desired exposure area of the thermal print medium, the thermal printer further including driver means for applying an electrical signal having a substantially constant amplitude to the thermal print element, said apparatus comprising:

electrical energy storage means representing the thermal mass of the thermal print element, said electrical energy storage means being adapted to provide a first signal whose amplitude is proportional to the instantaneous amount of electrical energy stored in said electrical energy storage means;

first means for transferring electrical energy into said electrical energy storage means at a rate proportional to the power being supplied to the thermal print element by the application of said substantially constant amplitude electrical signal thereto;

second means transferring electrical energy to and from said electrical energy storage means in relation to the heat transferred between the thermal print element and the environment in heat transfer relationship with the thermal print element, whereby the amplitude of said first signal is proportional to the instantaneous temperature of the thermal print element;

third means providing a second signal whose amplitude is related to the threshold temperature of the thermal print medium; and, fourth means concurrently enabling the driver means of the thermal printer and said first means, and concurrently disabling the driver means of the thermal printer and said first means whenever the amplitude of said first signal exceeds that of said second signal.

2. An apparatus as recited in claim 1, wherein the thermal printer is operative to maintain the thermal print medium stationary during exposure, and wherein said apparatus further comprises:

fifth means providing a third signal whose amplitude is related to a temperature that is sufficiently below the threshold temperature so as to not result in exposure of the thermal print medium upon movement thereof; and, sixth means enabling the thermal printer to move the thermal print medium whenever the amplitude of said first signal is less than the amplitude of said third signal.

3. An apparatus as recited in claims 1 or 2, wherein said third means includes means for selectively adjusting the amplitude of said second signal.

4. An apparatus as recited in claim 2, wherein said fifth means includes means for selectively adjusting the amplitude of said third signal.

5. An apparatus as recited in claims 1 or 2, wherein:

said electrical energy storage means includes a capacitance; said first signal is the voltage across said capacitance; said first means includes a gatable constant-current source that is enabled and disabled by said fourth means and that is operative when enabled to supply a constant current, proportional to the amplitude of the electrical signal applied to the thermal print element, to said capacitance; and, said third means is a voltage source and said second signal is a voltage provided by said voltage source.

6. An apparatus as recited in claim 2, wherein:

said electrical energy storage means includes a capacitance; said first signal is the voltage across said capacitance; said first means includes a gatable constant-current source that is enabled and disabled by said fourth means and that is operative when enabled to supply a constant current, proportional to the amplitude of the electrical signal applied to the thermal print element, to said capacitance; said third means is a voltage source and said second signal is a voltage provided by said voltage source; and, said fifth means is a second voltage source and said third signal is a voltage provided by said second voltage source.

7. An apparatus as recited in claim 5, wherein the thermal print element is formed on a substrate that is mounted on a block in the thermal printer and wherein the thermal print element and the substrate are in heat transfer relationship with the ambient air; and wherein said second means includes:

a resistance representing the heat transfer characteristic between the thermal print element and the substrate, with a first side of said resistance being coupled to said capacitance;

a second capacitance representing the thermal mass of the substrate, said second capacitance being coupled to a second side of said resistance;

a second resistance representing the heat transfer characteristic between the substrate and the block, with a first side of said second resistance being coupled to said second capacitance; and, a temperature sensor measuring the temperature of the block and applying a voltage related to said measured block temperature to a second side of said second resistance.

8. An apparatus as recited in claim 7, wherein said second means further includes:

a third resistance representing the heat transfer characteristic between the thermal print element and the thermal print medium and ambient air, with a first side of said third resistance being coupled to said capacitance;

a fourth resistance representing the heat transfer characteristic between the substrate and ambient air, with a first side of said fourth resistance being coupled to said second capacitance; and, a second temperature sensor measuring ambient air temperature and applying a voltage related to said measured ambient air temperature to second sides of said third and fourth resistances.

9. A method for precisely printing a plurality of incremental areas of machine-readable characters on a thermal print medium, any portion of which will change its light reflective characteristics when the temperature thereof equals or exceeds a predetermined threshold temperature, said method comprising the steps of:

maintaining the thermal print medium in uniform and good thermal contact with a selectively-energizable thermal print element whose area is substantially equal to the desired incremental area of a character to be printed and whose temperature increases when energized;

moving the thermal print medium relative to the thermal print element to each position at which an incremental area is to be printed; and, when the thermal print medium is at each said position:

energizing the thermal print element;

estimating the instantaneous temperature of the thermal print element through the use of a thermal model of the thermal print element and the heat transfer relationships between the thermal print element and its surrounding environment; and, deenergizing the thermal print element when the estimated temperature thereof exceeds a first temperature that is at least equal to the threshold temperature of the thermal print medium.

10. A method as recited in claim 9, further comprising the step of enabling movement of the thermal print medium from one of said positions to another of said positions only when the estimated temperature of the thermal print element is less than a second temperature that is sufficiently below the threshold temperature so as to not result in further printing of the thermal print medium upon movement thereof.

* * * * *

UNITED STATES PATENT AND TRADEMARK OFFICE

CERTIFICATE OF CORRECTION

PATENT NO. : 4,391,535

DATED : July 5, 1983

INVENTOR(S) : Roger C. Palmer

It is certified that error appears in the above—identified patent and that said Letters Patent is hereby corrected as shown below:

| | |
|---|---|
| Column 3, | line 27: "heting" should be — heating — |
| Column 7, | line 6: "the" should be — that — |
| Column 7, | line 7: "mode" should be — model — |
| Column 7, | line 46: "MOVE" should be — MOVE — |
| Column 8, | line 65: "theshold" should be -- threshold -- |

Signed and Sealed this

First Day of May 1984

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. 4,391,535

DATED July 5, 1983

INVENTOR(S) Roger C. Palmer

It is certified that error appears in the above—identified patent and that said Letters Patent is hereby corrected as shown below:

| | |
|---|---|
| Column 1, | line 1: insert — IMPROVED — before "METHOD" |
| Column 3, | line 27: "heting" should be — heating-- |
| Column 7, | line 6: "the" should be — that — |
| Column 7, | line 7: "mode" should be — model — |
| Column 7, | line 46: "MOVE" should be — $\overline{\text{MOVE}}$ — |
| Column 8, | line 37: "MOVE" should be — $\overline{\text{MOVE}}$ — |
| Column 8, | line 65: "theshold" should be — threshold — |

This certificate supersedes Certificate of correction issued May 1, 1984.

Signed and Sealed this

*Fourteenth* Day of *August 1984*

[SEAL]

*Attest:*

GERALD J. MOSSINGHOFF

*Attesting Officer*

*Commissioner of Patents and Trademarks*